US005644326A

United States Patent [19]

Lauzon et al.

[11] Patent Number: 5,644,326

[45] Date of Patent: Jul. 1, 1997

[54] DISPLAY DEVICE WITH ELECTRICALLY INTERCONNECTED DISPLAY ELEMENTS

[75] Inventors: Mark William Lauzon, Southgate; Charles Gerard Hellebuyck, Dearborn, both of Mich.

[73] Assignee: Ford Motor Company, Dearborn, Mich.

[21] Appl. No.: 435,099

[22] Filed: May 4, 1995

[51] Int. Cl.[6] ..... G09G 3/04

[52] U.S. Cl. ..... 345/34; 345/50

[58] Field of Search ..... 345/33, 34, 39, 345/45, 46, 47, 75, 76, 82; 340/815.4, 815.44, 815.45

[56] References Cited

U.S. PATENT DOCUMENTS

| | | | |
|---|---|---|---|
| 3,855,500 | 12/1974 | Yanagisawa . | |
| 3,868,542 | 2/1975 | Tanji | 345/47 |
| 3,945,003 | 3/1976 | Borg et al. | 345/34 |
| 4,044,280 | 8/1977 | Shulski . | |
| 4,204,209 | 5/1980 | Suehiro | 345/47 |
| 4,242,980 | 1/1981 | Go | 345/35 |
| 4,325,064 | 4/1982 | Kishino et al. . | |
| 4,847,728 | 7/1989 | Toula | 340/815.45 |
| 4,914,730 | 4/1990 | Fujita . | |
| 5,032,830 | 7/1991 | Kuijk | 345/91 |

FOREIGN PATENT DOCUMENTS

| | | | |
|---|---|---|---|
| 0071131 | 6/1977 | Japan | 345/34 |

*Primary Examiner*—Chanh Nguyen
*Attorney, Agent, or Firm*—Mark S. Sparschu

[57] ABSTRACT

In one embodiment of the present invention, a first diode is connected between two elements of a seven-segment display character. A second diode is also connected between two elements of the seven-segment display character. With the diodes so connected, the seven-segment display character can display the characters "1" through "9", and can do so with only six of the seven segments coupled to display driver circuitry. Electronic resources are thus saved in the control of the seven-segment display character.

3 Claims, 2 Drawing Sheets

DISPLAY DEVICE WITH ELECTRICALLY INTERCONNECTED DISPLAY ELEMENTS

BACKGROUND OF THE INVENTION

1. Field of the Invention

The present invention relates to electrical display devices.

2. Description of the Related Art

Electrical displays are used for many purposes. If an alphanumeric display is needed, a seven-segment display is often chosen. This display offers the advantage of being able to display all numerals from 0 through 9, and many alphabetic characters, via selective energizing of the seven display elements in the seven-segment display.

Having the ability to selectively energize the seven display elements in a seven-segment display conventionally implies providing an electronic driver with seven outputs. Each output would be connected to one element of the display.

However, in some instances, the ability to display all numerals from 0 to 9 may not be required. For example, in a given application, displaying numerals from 1 to 9 may meet all of the requirements of the application. In such instances, providing a display driver with the capability to drive all seven elements of the display independently may represent a waste of electronic resources.

Therefore, a system which can reduce the electronic resources needed when less than full display capability is required will provide advantages over the prior art.

SUMMARY OF THE INVENTION

The present invention provides a display device. The display device includes a display character comprising a plurality of display elements. Further, the display device includes a diode electrically coupling two display elements of the display character.

The present invention further provides another display device. This display device includes a display character comprising a plurality of display elements. Also, the display device comprises first blocking means electrically coupling two display elements of the display character for allowing current flow in one direction between the two display elements and blocking current flow in the other direction.

The present invention also provides another display device. This display device comprises a seven-segment display character. The display device further includes a first diode connected between elements "f" and "g" of the seven-segment display character, the diode having an anode and a cathode, the anode coupled to element "f" and the cathode coupled to element "g". Also, the display device comprises a second diode connected between elements "d" and "g" of the seven-segment display character, the diode having an anode and a cathode, the anode coupled to element "d" and the cathode coupled to element The present invention can reduce the electronic resources needed when less than full display ability is required from a display device. In doing so, the present invention provides advantages over the prior art.

DETAILED DESCRIPTION OF THE PREFERRED EMBODIMENT

Figure 10:
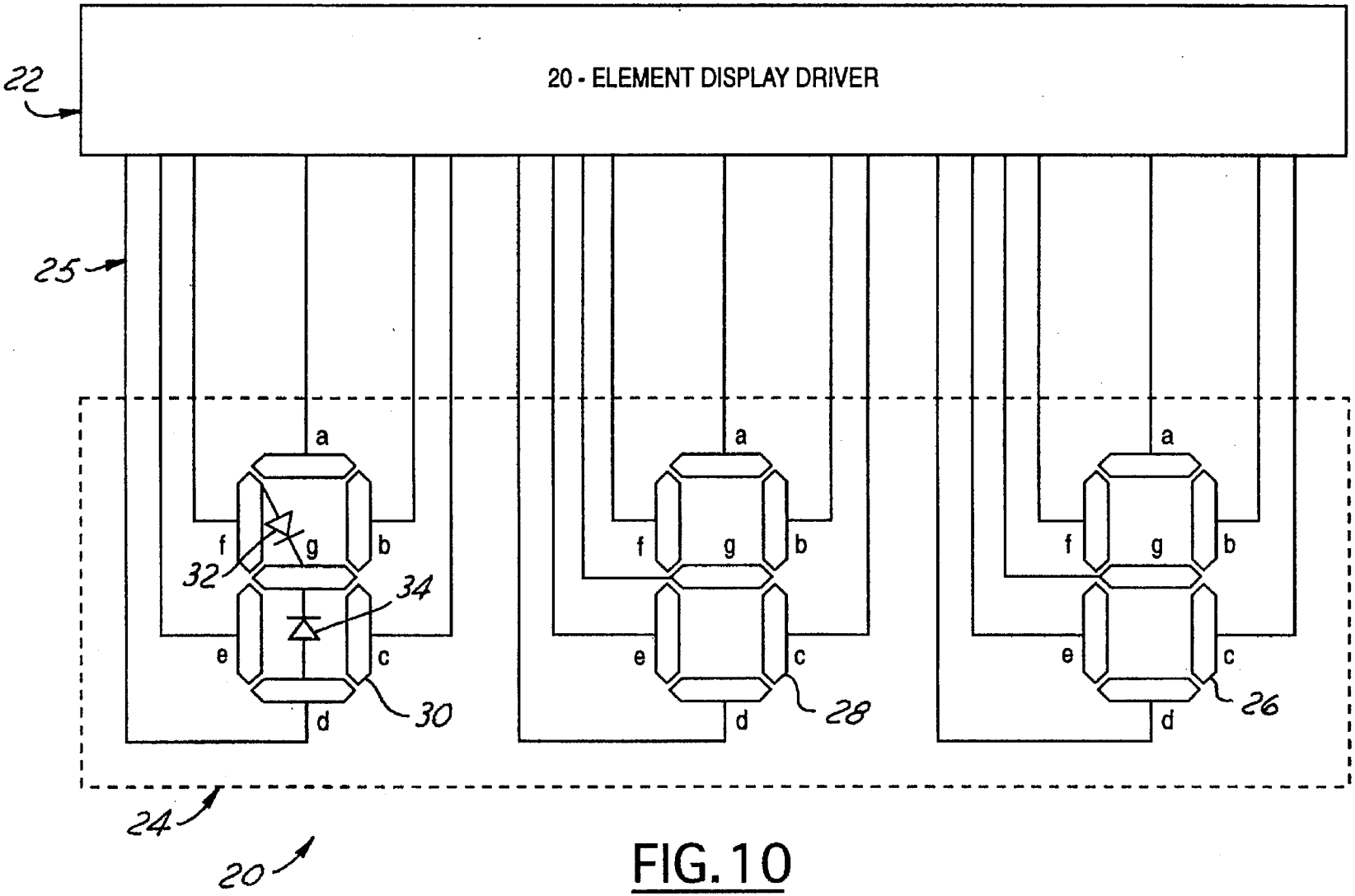
FIG. 10 depicts a display system 20 according to this embodiment of the present invention.

Referring to FIG. 10, a display system 20 according to one embodiment of the present invention is illustrated. Display system 20 includes display driver 22. In this embodiment of the present invention, display driver 22 has sufficient circuitry to independently drive 20 display elements. Display driver 22 may be a TL5812I integrated circuit from Texas Instruments Corporation.

Display device 24 is electrically coupled to display driver 22. This coupling takes place via circuits 25. Each circuit 25 connects an output of display driver 22 with a display element of display device 24.

In this embodiment of the present invention, display device 24 employs vacuum fluorescent (VF) display technology. Display device 24 has three characters 26, 28 and 30. Characters 26, 28 and 30 are preferably alphanumeric characters (i.e., capable of displaying alphabetic and/or numeric characters). Characters 26, 28 and 30 are further preferably seven-segment characters, a type of alphanumeric character. Characters 26, 28 and 30 are called "seven-segment" characters because they are composed of seven display elements, labelled (a) through (g) in FIG. 10.

Characters 26 and 28 are wired as they would be in a conventional display device. That is, each of the seven elements of characters 26 and 28 (14 elements in all) are electrically connected via a circuit 25 to display driver 22.

In character 30, elements (a) through (f) are each similarly connected via a circuit 25 to display driver 22. But, element (g) is not so connected to display driver 22. Instead, element (g) is connected via diodes 32 and 34 to elements (f) and (d). Diode 32 electrically connects elements (g) and (f). Diode 32 is connected with its anode coupled to element (f) and its cathode coupled to element (g). With diode 32 so oriented, current can flow from element (f) to element (g), but current is blocked in the opposite direction (i.e., from element (g) to element (f)). Diode 34 electrically connects elements (g) and (d). Diode 34 is connected such that current can flow from element (d) to element (g), but current is blocked in the opposite direction.

The operation of system 20 will now be described. The control of characters 26 and 28 is performed in the conventional manner. That is, for each element (a) through (g) which is to be displayed, the corresponding circuit 25 is energized by display driver 22. Operating in this manner, every numeral from 0 through 9 can be displayed on each of characters 26 and 28.

The control of character 30 is different than the control of characters 26 and 28, because there is not a one-to-one correspondence between a circuit 25 and each element (a)

through (g) of character 30. (Recall that there is no circuit 25 connecting display driver 22 with element (g) of character 30.) Numerals 1 through 9 can however be displayed using character 30, as illustrated in FIGS. 1 through 9.

Figure 1:
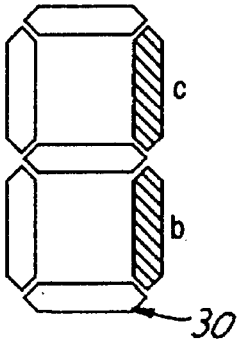
FIG. 1 illustrates how the numeral "1" can be displayed in one embodiment of the present invention.
Figure 2:
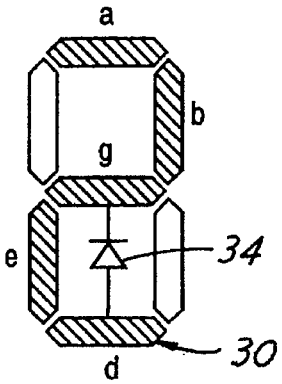
FIG. 2 illustrates how the numeral "2" can be displayed in this embodiment of the present invention.
Figure 3:
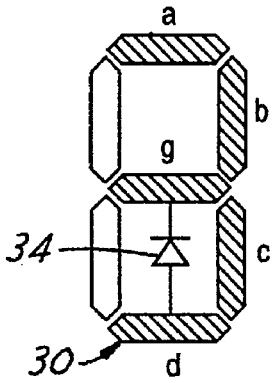
FIG. 3 illustrates how the numeral "3" can be displayed in this embodiment of the present invention.
Figure 4:
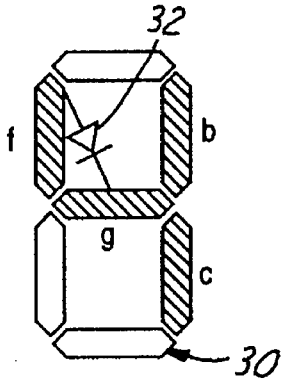
FIG. 4 illustrates how the numeral "4" can be displayed in this embodiment of the present invention.
Figure 5:
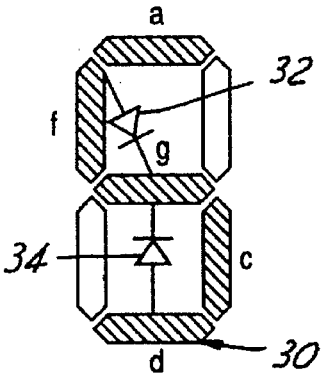
FIG. 5 illustrates how the numeral "5" can be displayed in this embodiment of the present invention.
Figure 6:
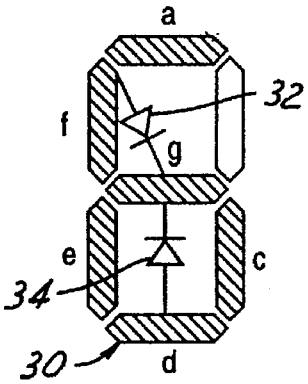
FIG. 6 illustrates how the numeral "6" can be displayed in this embodiment of the present invention.
Figure 7:
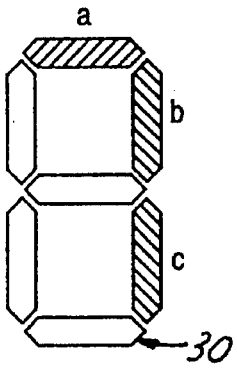
FIG. 7 illustrates how the numeral "7" can be displayed in this embodiment of the present invention.

For example, referring to FIG. 1, the numeral "1" can be displayed by energizing elements (b) and (c). Further, referring to FIG. 3, the numeral "3" can be displayed by energizing elements (a), (b), (c) and (d). When element (d) is so energized, element (g) will also be energized, via diode 34.

Figure 8:
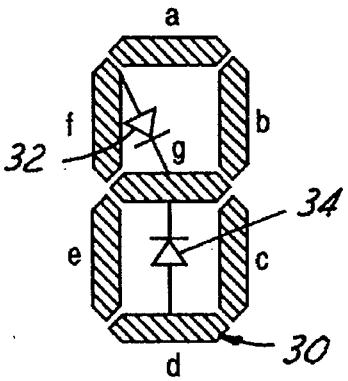
FIG. 8 illustrates how the numeral "8" can be displayed in this embodiment of the present invention.
Figure 9:
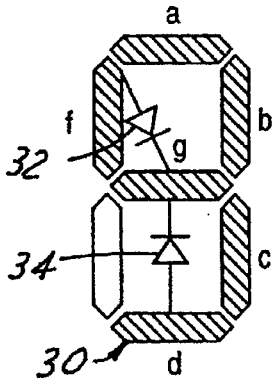
FIG. 9 illustrates how the numeral "9" can be displayed in this embodiment of the present invention.

As another example, FIG. 8 shows how the numeral "8" can be displayed. The numeral "8" can be displayed by energizing elements (a), (b), (c), (d), (e) and (f). Element (g), though not connected by a circuit 25 to display driver 22, is energized by diodes 32 and 34.

FIGS. 1 through 9 thereby illustrate that in this embodiment of the present invention, character 30 can display the numerals 1 through 9. Further, then, FIG. 10 illustrates that characters 26, 28 and 30 can display any number from 0 to 999. This considerable display capability is achieved while employing only a 20-element display driver 22. Conventionally, a 21-element display driver (or even a larger driver, if no 21-element driver happens to be available) is required to provide this capability with three seven-segment display characters.

Various other-modifications and variations will no doubt occur to those skilled in the arts to which this invention pertains. Such variations which generally rely on the teachings through which this disclosure has advanced the art are properly considered within the scope of this invention. This disclosure should thus be considered illustrative, not limiting; the scope of the invention is instead defined by the following claims.

What is claimed is:

1. A display device comprising:

a display character comprising a plurality of display elements;

a first diode having a first anode and a first cathode, said diode electrically connected between two said display elements with said first anode coupled to one said display element and said first cathode coupled to another said display element; and a second diode electrically coupling two elements; wherein said display character is a seven-segment display character;

said second diode has a second anode and a second cathode;

said first diode is connected between elements "f" and "g" of said display character with said first anode coupled to element "f" and said first cathode coupled to element "g"; and said second diode is connected between elements "d" and "g" of said display character with said second anode coupled to element "d" and said second cathode coupled to element "g".

2. A display device comprising:

a display character comprising a plurality of display elements;

first blocking means electrically coupling two said display elements for allowing current flow in one direction between said two display elements and blocking current flow in the other direction; and second blocking means electrically coupling two said display elements for allowing current flow in one direction between said two display elements and blocking current flow in the other direction; wherein said display character is a seven-segment display character;

said first blocking means is connected between elements "f" and "g" of said display character such that current flow from element "g" to element "f" is blocked by said first blocking means; and said second blocking means is connected between elements "d" and "g" of said display character such that current flow from element "g" to element "d" is blocked by said second blocking means.

3. A display device comprising:

a seven-segment display character;

a first diode connected between elements "f" and "g" of said seven-segment display character, said first diode having a first anode and a first cathode, said first anode coupled to element "f" and said first cathode coupled to element "g"; and a second diode connected between elements "d" and "g" of said seven-segment display character, said second diode having a second anode and a second cathode, said second anode coupled to element "d" and said second cathode coupled to element "g".

* * * * *